US008157586B2

(12) United States Patent
Mullins

(10) Patent No.: US 8,157,586 B2
(45) Date of Patent: Apr. 17, 2012

(54) CONNECTOR HAT WITH EXTENDED MOUNTING POSTS FOR SECURING A CONNECTOR SHELL TO A CIRCUIT BOARD

(75) Inventor: Gregory Loyd Mullins, Atlanta, GA (US)

(73) Assignee: Genesis Technology USA, Inc., Norcross, GA (US)

( * ) Notice: Subject to any disclaimer, the term of this patent is extended or adjusted under 35 U.S.C. 154(b) by 0 days.

(21) Appl. No.: 12/778,582

(22) Filed: May 12, 2010

(65) Prior Publication Data

US 2011/0217869 A1 Sep. 8, 2011

Related U.S. Application Data

(60) Provisional application No. 61/310,144, filed on Mar. 3, 2010.

(51) Int. Cl.
*H01R 13/73* (2006.01)

(52) U.S. Cl. ..... 439/572; 439/607.28

(58) Field of Classification Search ..... 439/572, 439/607.37, 571, 607.28, 939, 148–150
See application file for complete search history.

(56) References Cited

U.S. PATENT DOCUMENTS 5,017,158 A 5/1991 Liu et al.
5,254,010 A 10/1993 Davis
6,000,968 A 12/1999 Hagiwara
6,343,956 B2 * 2/2002 Stickney ..... 439/607.17
6,986,681 B2 1/2006 Tsai
2006/0134952 A1 * 6/2006 Meister et al. ..... 439/148
2008/0139049 A1 6/2008 Masumoto et al.
2009/0258536 A1 * 10/2009 Lee et al. ..... 439/567

OTHER PUBLICATIONS

International Search Report dated Jul. 2, 2010 in International Application No. PCT/US2010/034728.

* cited by examiner

*Primary Examiner* — Tulsidas C Patel
*Assistant Examiner* — Harshad Patel
(74) *Attorney, Agent, or Firm* — Hope Baldauff Hartman, LLC

(57) ABSTRACT

Concepts and technologies described herein provide for securing a connector shell to a circuit board using a separate connector hat with elongated mounting posts. According to one aspect of the disclosure provided herein, a connector hat includes a one-piece body with a top surface and a pair of mounting posts. The mounting posts extend downwards from opposing side edges of the top surface. The posts are of sufficient length to extend beyond a bottom surface of a connector shell to which the connector hat is configured to attach, and through a bottom surface of an associated circuit board. The two-piece connector assembly design utilizing the connector hat with mounting posts allows the mounting posts to be manufactured at any desirable length to facilitate installation of the connector assembly to a circuit board.

13 Claims, 10 Drawing Sheets

FRONT
PERSPECTIVE

REAR
PERSPECTIVE

FRONT
PERSPECTIVE

REAR
PERSPECTIVE

EXPLODED FRONT PERSPECTIVE

EXPLODED REAR PERSPECTIVE

FRONT PERSPECTIVE

REAR PERSPECTIVE

FRONT
PERSPECTIVE

REAR
PERSPECTIVE

CONNECTOR HAT WITH EXTENDED MOUNTING POSTS FOR SECURING A CONNECTOR SHELL TO A CIRCUIT BOARD

CROSS-REFERENCE TO RELATED APPLICATIONS

This application claims priority to U.S. Provisional Patent Application No. 61/310,144, filed on Mar. 3, 2010, and entitled "Connector Hat with Extended Mounting Posts for Securing a Connector Shell to a Circuit Board," which is expressly incorporated herein by reference in its entirety.

BACKGROUND

Conventional connector shells, such as for use with High Definition Multimedia Interface (HDMI) connectors, utilize at least two mounting posts for securing the connector shell to the corresponding circuit board. These mounting posts extend through apertures in the circuit board and are then soldered to a rear side of the board, securing the connector shell to the circuit board. Typically, these mounting posts and connector shells are stamped from a single piece of material and bent into a mounting configuration in one of two ways. First, the mounting posts may be formed as part of the side walls of the connector shell such that the vertically oriented mounting posts extend in front of the connector shell within the same planes as the side walls before the mounting posts are bent into place by rotating them outward and rearward until they overlap the side walls.

A second method for forming the mounting posts is to cut the posts from an underside of the connector shell and pull the posts downward from the bottom surface of the shell, pivoting the posts outward until they are substantially coplanar with the side walls. With both methods, the connector shells may include securing tabs extending upwards from a front edge of the top surface and having a screw hole for securing the corresponding connector assembly to a computer housing or other structure.

However, since the mounting posts and securing tabs are generally formed from the same piece of material used for the entire connector shell, configuration changes to any of the individual elements of the connector assembly are not possible. Rather, any configuration changes to the connector shell, mounting posts, and/or method of mounting a connector assembly to an apparatus via the securing tab will necessitate an entirely new connector assembly, as all components are stamped from a single piece of material. Moreover, for connector shells in which the mounting posts are pulled from the bottom surface of the shell, the existence and required location of retention springs in the bottom surface of the connector shell limits the allowable length of the mounting posts pulled from the bottom. Limiting the length of the mounting posts may prohibit a sufficient length of the mounting posts to protrude through the circuit board to ensure a quality solder connection when securing the connector assembly to the circuit board.

It is with respect to these considerations and others that the disclosure made herein is presented.

SUMMARY

It should be appreciated that this Summary is provided to introduce a selection of concepts in a simplified form that are further described below in the Detailed Description. This Summary is not intended to be used to limit the scope of the claimed subject matter.

Apparatuses and methods described herein provide for the use of a connector hat to mount a connector shell to a circuit board. According to aspects presented herein, a connector hat includes a one-piece body that attaches to a top surface of a connector shell. The one-piece body has a top surface and a pair of mounting posts that extend downward from opposing sides of the top surface. The mounting posts are longer than the connector shell height so that they extend beyond the bottom surface of the connector shell when attaching the shell to the circuit board.

According to other aspects of the disclosure, a connector assembly includes a connector shell and a connector hat. The connector hat includes a one-piece body that is attached to a top surface of the shell. The connector hat has a top surface and a pair of mounting posts extending downward from opposing sides of the top surface so that they overlap the sides of the connector shell. Each mounting post extends beyond a bottom surface of the connector shell for mounting the connector assembly to a circuit board.

According to yet other aspects, a method is provided for securing a connector shell to a circuit board. A connector hat is attached to a top surface of the connector shell to create a connector assembly with mounting posts of the connector hat extending past a bottom surface of the connector shell. The connector assembly is installed on the circuit board with electrical contacts of the shell mating with corresponding contacts of the circuit board. The mounting posts are positioned within holes in the circuit board so that the ends of the mounting posts protrude through a bottom surface of the circuit board. The ends of the mounting posts are then fixed to the bottom surface of the circuit board.

The features, functions, and advantages discussed herein can be achieved independently in various embodiments of the present disclosure or may be combined in yet other embodiments, further details of which can be seen with reference to the following description and drawings.

DETAILED DESCRIPTION

Figure 1:
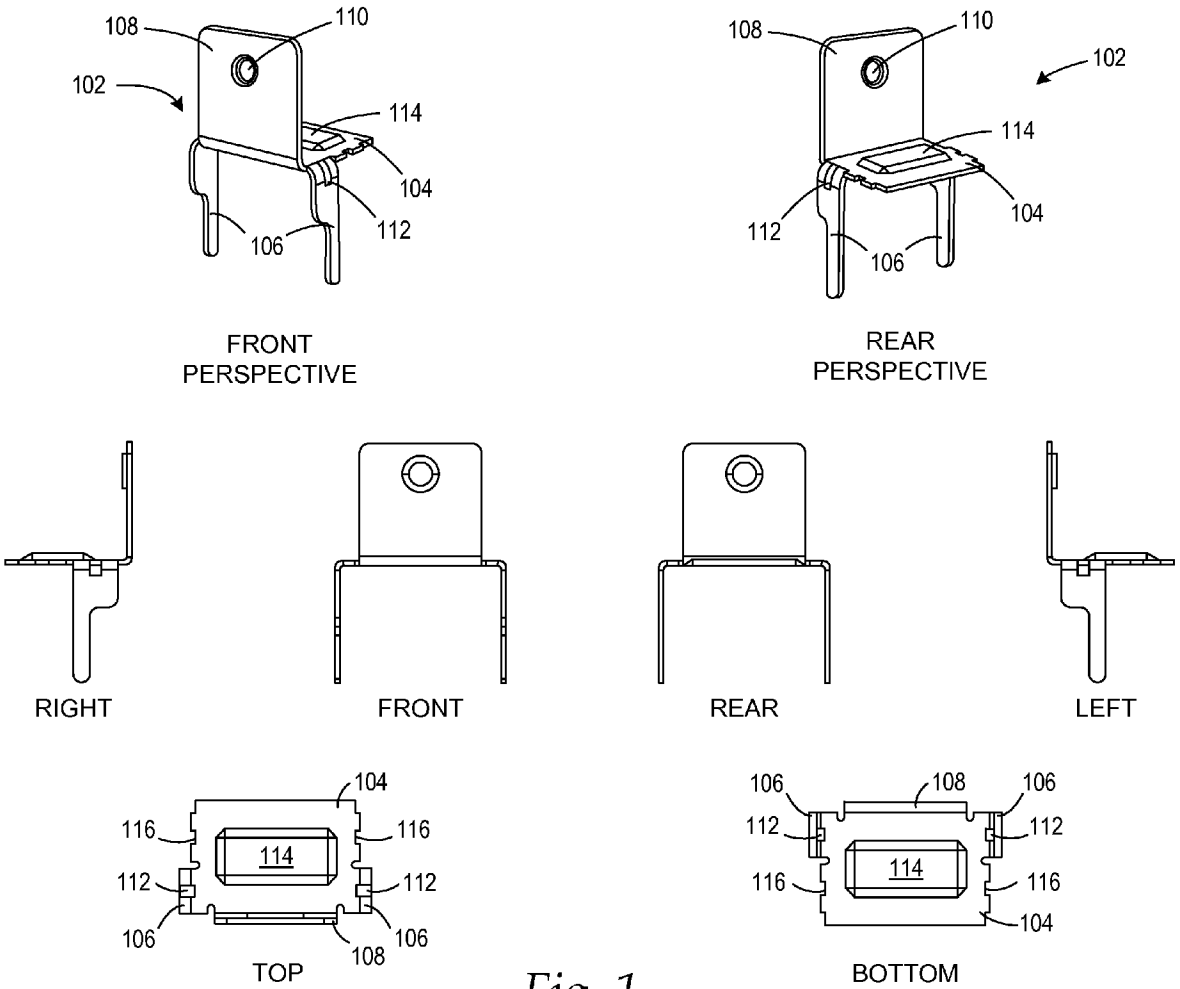
FIG. 1 includes multiple views of a connector hat with securing tab for mounting a connector shell to a circuit board according to embodiments described herein.

The following detailed description is directed to apparatuses and methods for utilizing a connector hat for securing a connector shell to a circuit board. Utilizing the embodiments provided herein, mounting posts for use in soldering or otherwise securing a connector shell (such as an HDMI connector shell) are not stamped and pulled from a single piece of material along with the other conventional connector shell components (i.e., side walls, top, bottom, rear). Rather the mounting posts used to solder the connector shell to the circuit board are included with a connector hat component, which may also include a securing tab for securing the connector assembly to the circuit board. It should be appreciated that as used throughout this disclosure, the connector assembly may include the combination of connector components secured to a circuit board. For example, a connector assembly may include a connector shell without mounting posts, coupled with a connector hat having the mounting posts and with or without a securing tab as will be described below.

In the following detailed description, references are made to the accompanying drawings that form a part hereof, and that show, by way of illustration, specific embodiments or examples. The drawings are not drawn to scale. Accordingly, the dimensions or proportions of particular elements, or the relationships between those different elements, as shown in the drawings are chosen only for convenience of description, but do not limit possible implementations of this disclosure. Like numerals represent like elements throughout the several figures.

Turning now to FIG. 1, a connector hat 102 will be described according to a first embodiment. FIG. 1 shows front perspective, rear perspective, front rear, right, left, top, and bottom views of the connector hat 102 for clarity. According to one embodiment, the connector hat 102 includes a top surface 104, a pair of opposing mounting posts 106, and a securing tab 108. The top surface 104 is shaped and sized to abut the top surface of a corresponding connector shell, as will be shown and described in greater detail below with respect to FIGS. 2-4. According to this embodiment, a securing tab 108 extends approximately 90 degrees upwards from a front edge of the top surface 104 of the connector hat 102, while the opposing mounting posts 106 extend approximately 90 degrees downward from opposing side edges of the top surface 104. The mounting posts 106 will be described in detail below with respect to FIG. 2.

Although the bend angles of the mounting posts 106 and securing tab 108 are shown to be approximately 90 degrees from a plane defined by the top surface 104, it should be appreciated that any bend angle may be utilized within the scope of this disclosure according to the specific implementation. For example, the configuration of a corresponding circuit board to which the connector hat 102 and attached connector shell will be mounted may dictate a bend angle other than 90 degrees for the mounting posts 106. Similarly, the configuration of the computer or other component to which the connector hat 102 and attached connector shell and circuit board will be installed may necessitate an alternative bend angle or positioning of the securing tab 108.

The securing tab 108 may include one or more fastener apertures 110 for securing the connector assembly, which includes the connector hat 102 and attached connector shell, to a computer component or other apparatus. The fastener aperture 110 may be sized and located according to the type of desired fastener and according to the apparatus to which the connector assembly will be secured. The securing tab 108 may additionally be of any size and configuration according to the particular application. It will become clear that by utilizing a two-piece design for a connector assembly, with the connector hat 102 separate from the connector shell, the same "generic" connector shell may be utilized in any number of implementations by selecting the appropriate connector hat corresponding to the particular application. For example, a technician may stock a large number of connector shells for all implementations and simply select the appropriate connector hat 102 for any given situation according to the specific implementation in which the connector assembly is being used. If the connector assembly is being used in an application in which a particular screw is to be used to secure the assembly to a component, then the technician would select a generic connector shell and a connector hat 102 that has a securing tab 108 with a fastener aperture 110 sized and threaded according to the desired screw.

Similarly, if the connector assembly is not being secured to an apparatus using a fastener, then the technician could select a connector hat having no securing tab 108, as will be shown and described below with respect to a second embodiment shown in FIGS. 5-9. It should be appreciated from these examples that the connector hat 102 may be configured with any number and type of securing mechanisms corresponding to any number of applications for the connector assembly.

According to various embodiments, the top surface 104 of the connector hat 102 includes slots 112 and 116 on opposing side edges that are sized to receive locking tabs on the connector shell in order to secure the connector hat 102 to the shell, as will be shown and described below. As can be seen in the top and bottom views of FIG. 1 and others, the slots on the connector hat 102 include a slot 112 in each mounting post 106 and a slot 116 on each side of the top surface 104 rearward of the mounting posts 106. As will become clear from FIGS. 2-4 below, the slots 112 and 116 allow the connector hat 102 to be pressed onto the top of a connector shell so that locking tabs protruding from the connector shell are received and secured by the slots 112 and 116. It should be appreciated that any number and type of slots 112 and 116 may be included and that the securing mechanism for securing the connector hat 102 to the connector shell is not limited to the slot and locking tab combinations shown and described.

As seen best from the front and rear perspective, top, and bottom views of the connector hat 102, the connector hat 102 may have a recessed area 114 in an underside of the top surface 104 that provides a gap between the connector hat 102 and the top surface of the connector shell to which the connector hat 102 will be attached. This gap allows for the upward movement of retention springs within the connector shell that secure a connector to the connector shell when mating.

Figure 2:
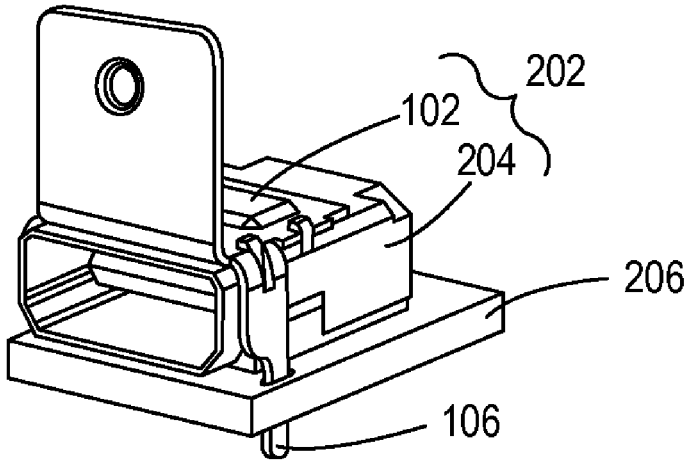
FIG. 2 includes front and rear perspective views of a connector assembly mounted to a circuit board, the connector assembly including a connector hat with securing tab to mount a connector shell to the circuit board according to embodiments described herein.
Figure 2:
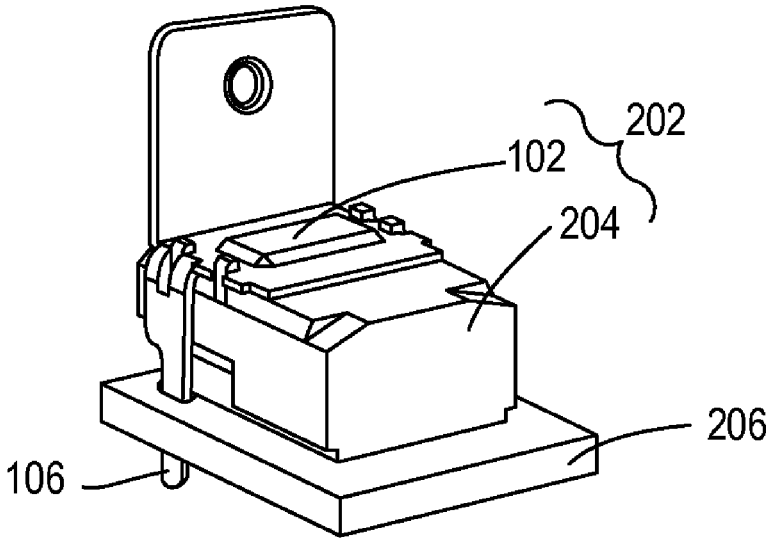

FIG. 2 shows a connector assembly 202 mounted to a circuit board 206. The connector assembly 202 includes a connector hat 102 and connector shell 204 combination. The connector assembly 202 is mounted and fixed to the circuit board 206 via the mounting posts 106 of the connector hat 102. It should be appreciated that while the various figures depict the connector shell 204 as being an HDMI connector shell, the connector hats 102 described herein may be utilized to mount any type of connector or other apparatus to a circuit board 206 in the manner described below. The precise dimensions of the connector hat 102 compliment the dimensions of the connector shell 204 being mounted to the circuit board 206. As is clear from the illustrated views of FIG. 2, the mounting posts 106 of the connector hat 102 protrude substantially from a bottom side of the circuit board 206, providing a prominent solder fillant on the bottom side of the circuit board 206 for soldering the connector assembly 202 to the circuit board 206. According to one embodiment, the mounting posts 106 protrude approximately 3.2 millimeters from a bottom surface of the connector shell 204.

This substantial length of the mounting posts 106 provides a significant improvement over conventional connector assemblies in which the posts are pulled from a bottom side of the connector shell. Conventional mounting posts pulled from a bottom side of the connector shell may be approximately 1.9 millimeters long. As previously stated, the retention springs in the bottom side of the shell, as well as the amount of material bent from each side to create the bottom side of a conventional shell, limits the length of the mounting posts pulled from the bottom of a conventional connector shell. By utilizing a separate connector hat 102 with attached mounting posts 106 to mount the connector assembly to the circuit board 206 as shown in the figures, the mounting posts 106 may be lengthened to any desirable length, which facilitates the process of mounting the connector assembly 202 to a circuit board 206.

Figure 3:
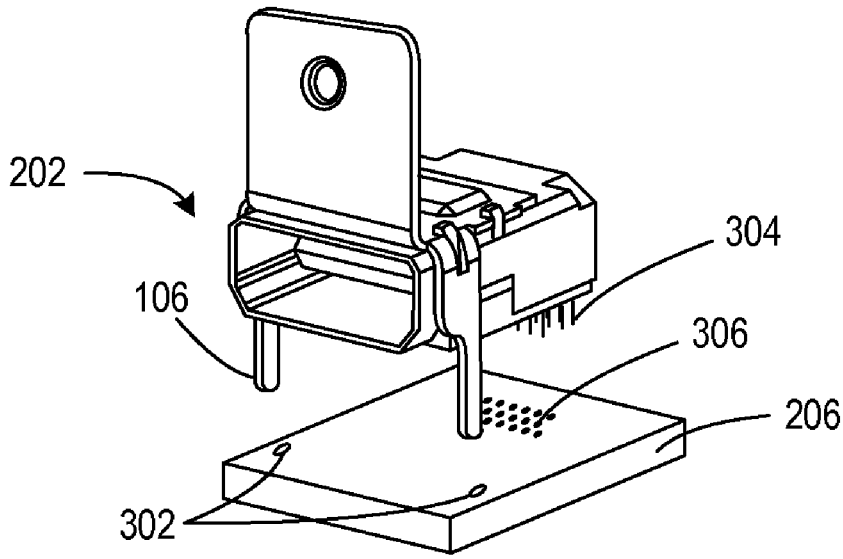
FIG. 3 includes front and rear partially exploded perspective views of a connector assembly and a circuit board, the connector assembly including a connector hat with securing tab to mount a connector shell to the circuit board according to embodiments described herein.
Figure 3:
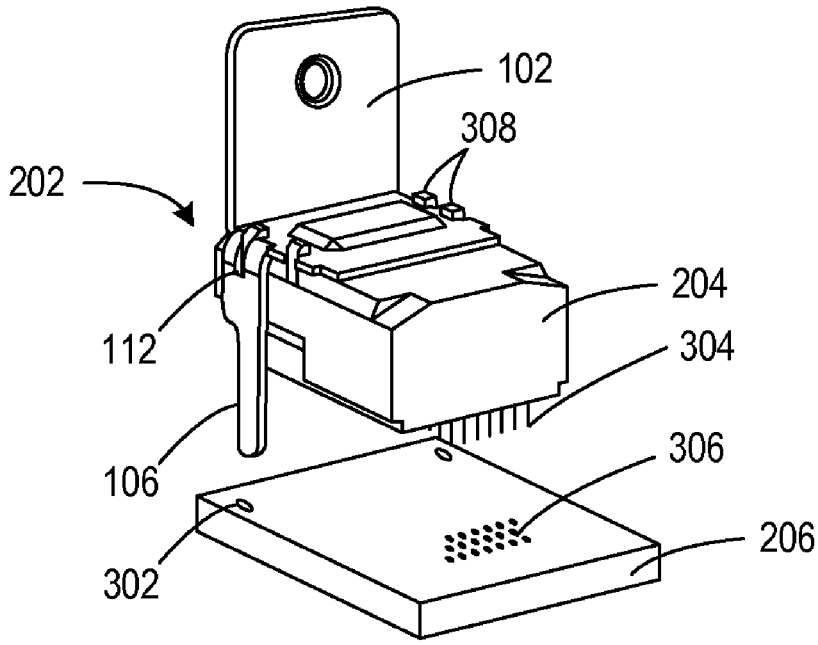
Figure 4:
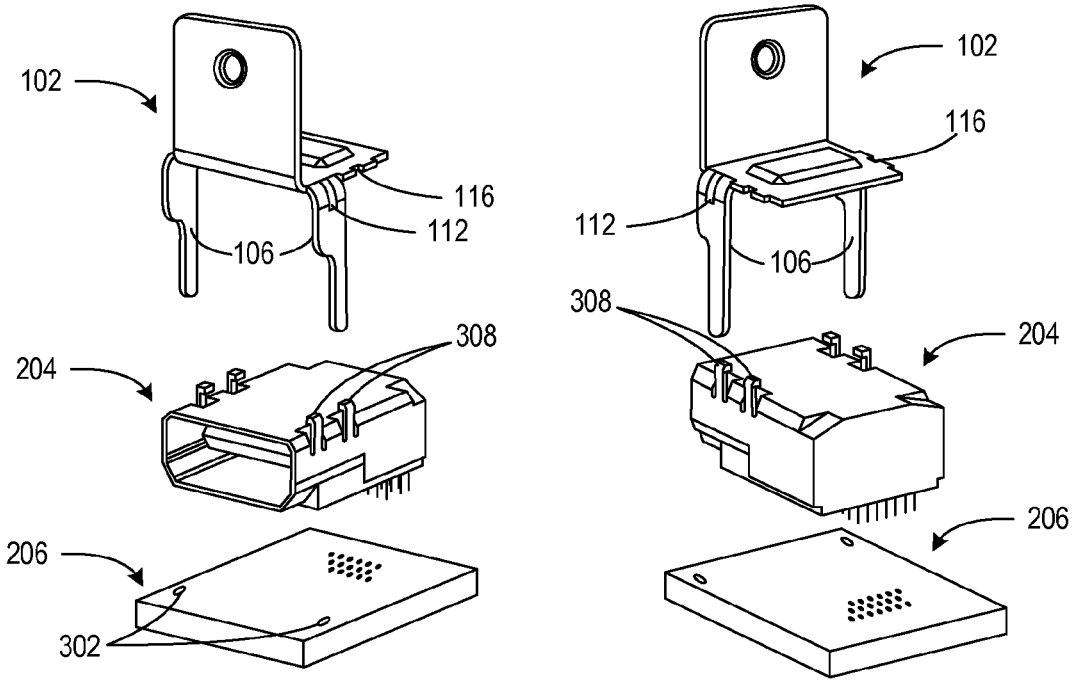
FIG. 4 includes front and rear exploded perspective views of a connector hat with a securing tab, a connector shell, and a circuit board according to embodiments described herein.
Figure 5:
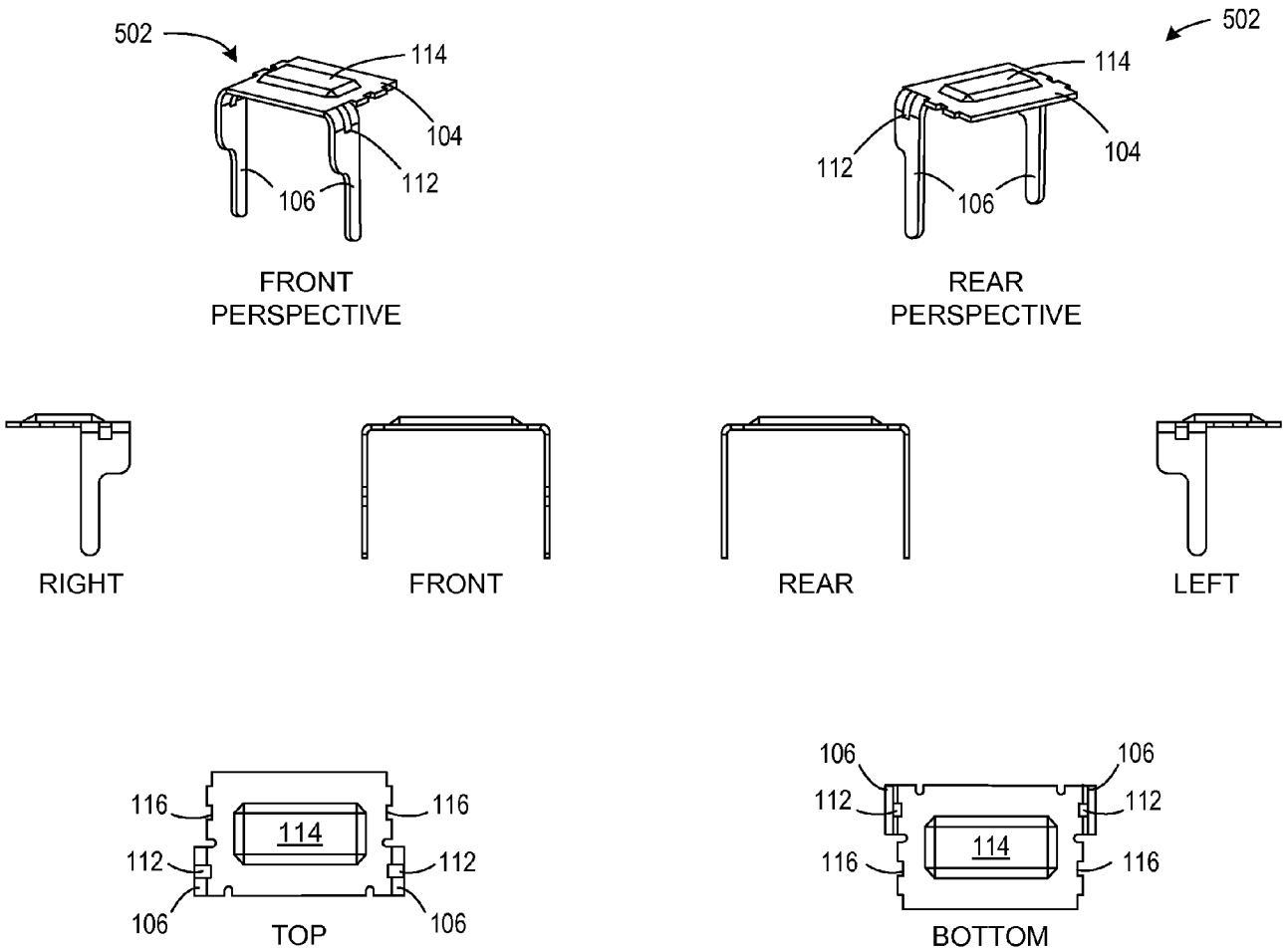
FIG. 5 includes multiple views of a connector hat without a securing tab for mounting a connector shell to a circuit board according to embodiments described herein.
Figure 6:
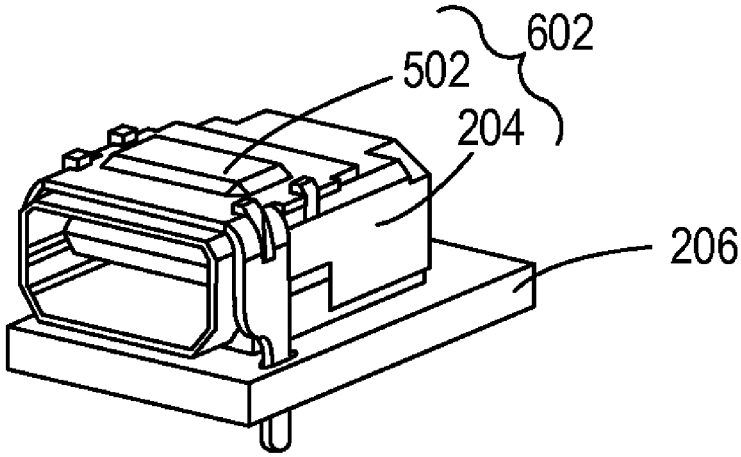
FIG. 6 includes front and rear perspective views of a connector assembly mounted to a circuit board, the connector assembly including a connector hat without a securing tab to mount a connector shell to the circuit board according to embodiments described herein.
Figure 6:
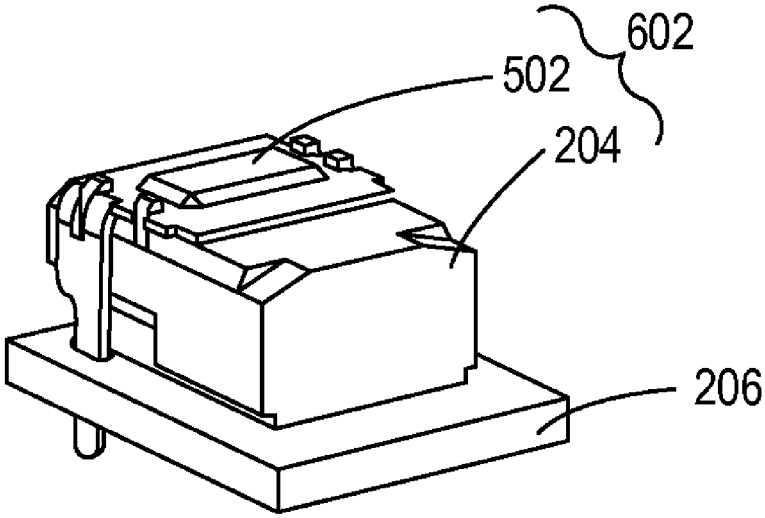
Figure 7:
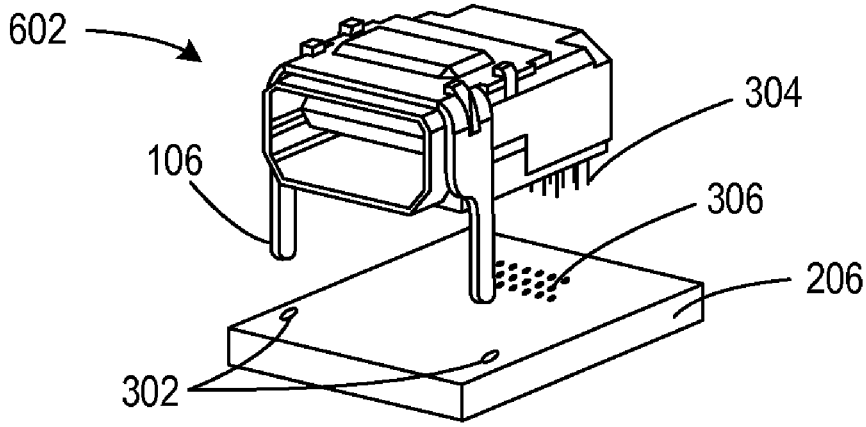
FIG. 7 includes front and rear partially exploded perspective views of a connector assembly and a circuit board, the connector assembly including a connector hat without a securing tab to mount a connector shell to the circuit board according to embodiments described herein.
Figure 7:
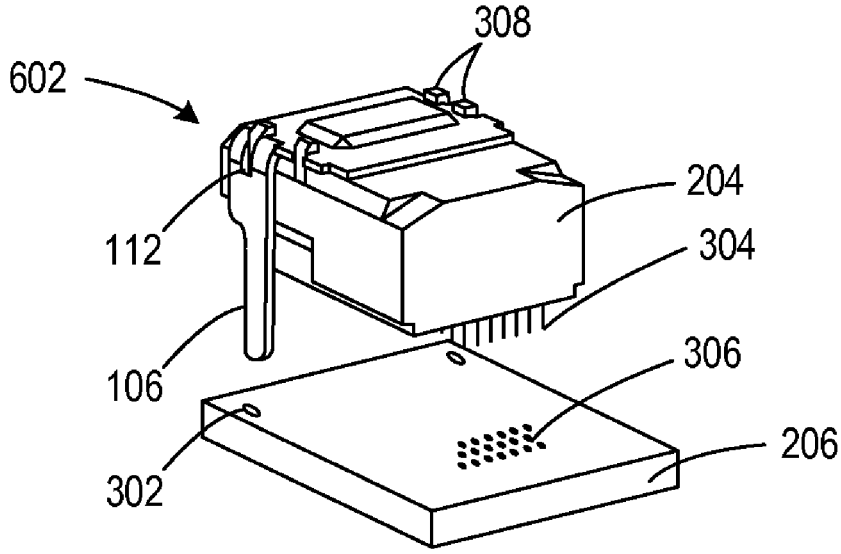
Figure 8:
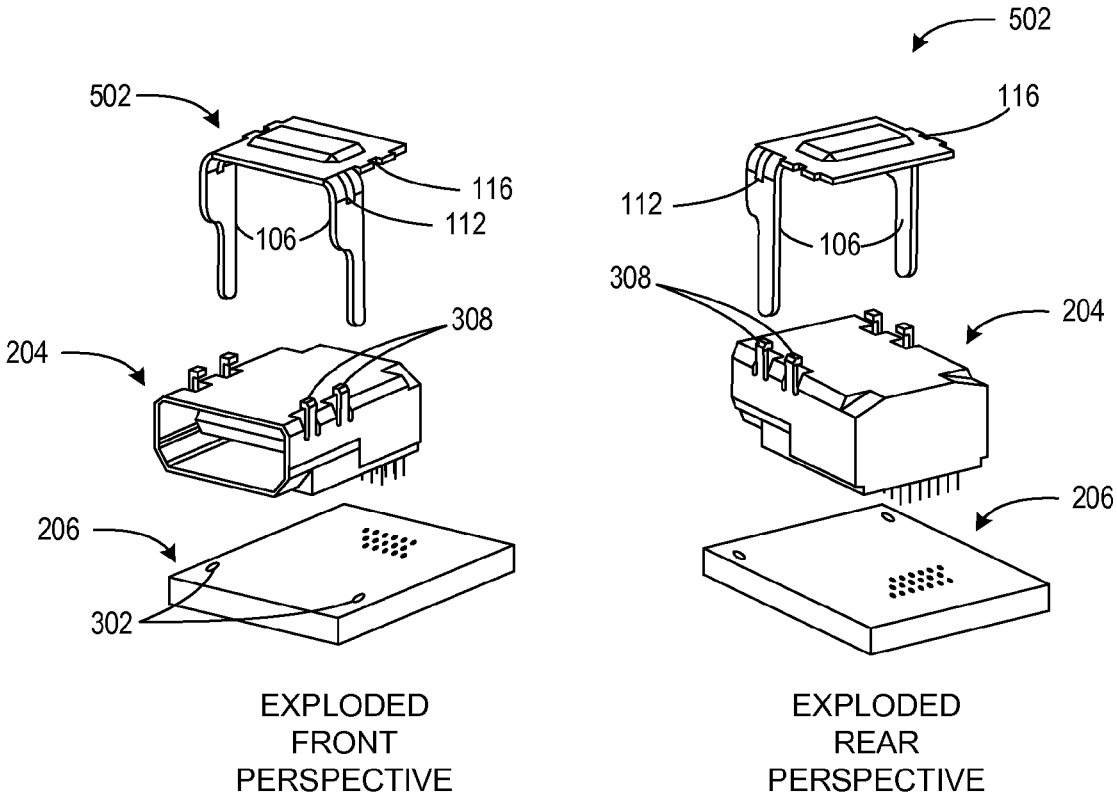
FIG. 8 includes front and rear exploded perspective views of a connector hat without a securing tab, a connector shell, and a circuit board according to embodiments described herein.

FIGS. 3 and 4 show partially exploded and exploded views, respectively, of a connector assembly 202 and circuit board 206 to illustrate the various structural details of the connector hat 102 and connector shell 204 combination according to various embodiments described herein. Looking at FIGS. 2-4, it can be seen that during installation of the connector assembly 202, the mounting posts 106 of the connector hat 102 are inserted into corresponding circuit board apertures 302, while the electrical contacts 304 of the connector shell 204 are mated with the circuit board contacts 306. FIG. 4 clearly shows that assembly of the connector assembly 202 merely involves pressing the connector hat 102 onto the top surface of the appropriate connector shell 204, while aligning the slots 112 and 116 of the connector hat 102 with the locking tabs 308 of the connector shell 204. The locking tabs 308 snap into place around the top surface 104 of the connector hat 102 to hold the connector assembly 202 together, while the configuration of the slots 112 and 116 prevent forward and aft movement of the installed connector hat 102 over the top surface of the connector shell 204. It should be appreciated that any number and configuration of slots 112/116 and locking tabs 308 may be used to secure the connector hat 102 and connector shell 204 together.

FIGS. 5-8 show a second embodiment of a connector hat 502 and corresponding connector assembly 602. This embodiment is substantially similar to the embodiment discussed above with respect to FIGS. 1-4, although the connector hat 502 does not include a securing tab 108. The connector hat 502 may be useful in applications in which it is not necessary to secure the connector assembly 602 to a computer component or other structure. This embodiment illustrates an advantage in utilizing a two-piece connector assembly design in which the connector hat 102/502 includes the mounting posts 106 and is separate from the connector shell 204. By manufacturing the connector hat 502 without the securing tab 108, manufacturing costs may be reduced since less material is used. The versatility of the two-piece connector assembly design allows for generic connector shells to be manufactured for each type of corresponding connector, and then separate connector hats to be manufactured and utilized according to the specific implementation.

Figure 9:
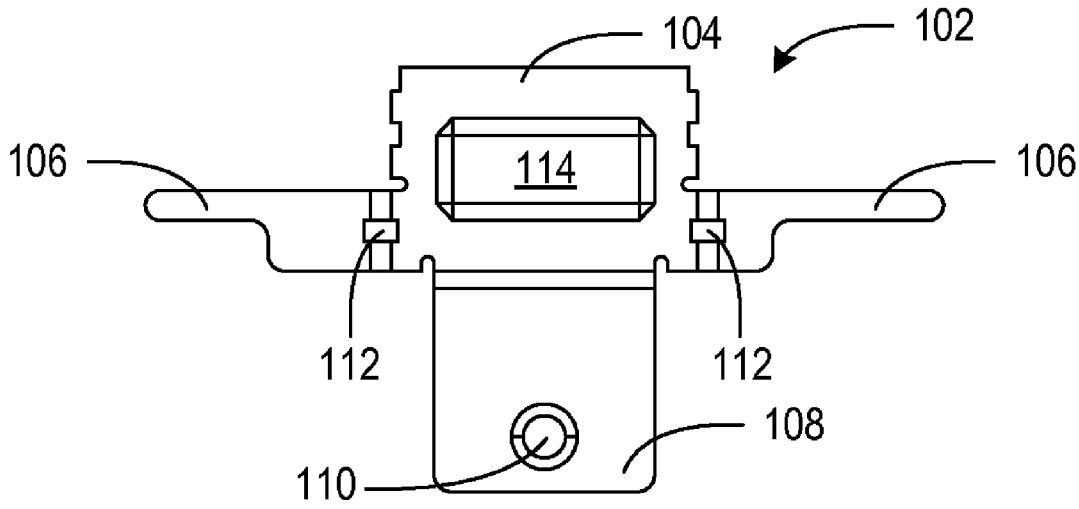
FIG. 9 includes top views of a connector hat with a securing tab and of a connector hat without a connector hat, each configured flat prior to bending into final shape according to embodiments described herein.
Figure 9:
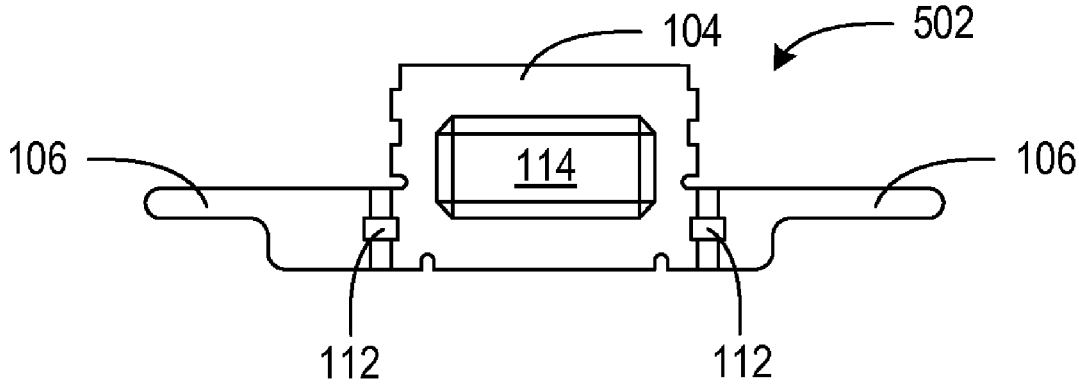

FIG. 9 shows a top view of connector hats 102 and 502 after being stamped from a sheet of material, such as steel. As shown, the mounting posts 106 have not yet been folded downward from the top surface 104, and the securing tab 108 has not yet been folded upwards from the top surface 104 of the connector hat 102. A fastener aperture 110 can be seen in the securing tab 108 according to this embodiment, and the slots 112/116 for receiving the locking tabs 308 of the connector shell 204 can be seen at a juncture between the mounting posts 106 and the top surface 104. According to one embodiment, the connector hat 102/502 is manufactured from cold rolled steel, which provides an advantage over a conventional one-piece connector hat/shell design in which the securing tab and mounting posts are stamped from the same piece of material as the connector shell. In conventional applications, the connector shell may be manufactured from phosphor bronze, which is more expensive than the steel used in the connector hat 102/502.

Figure 10:
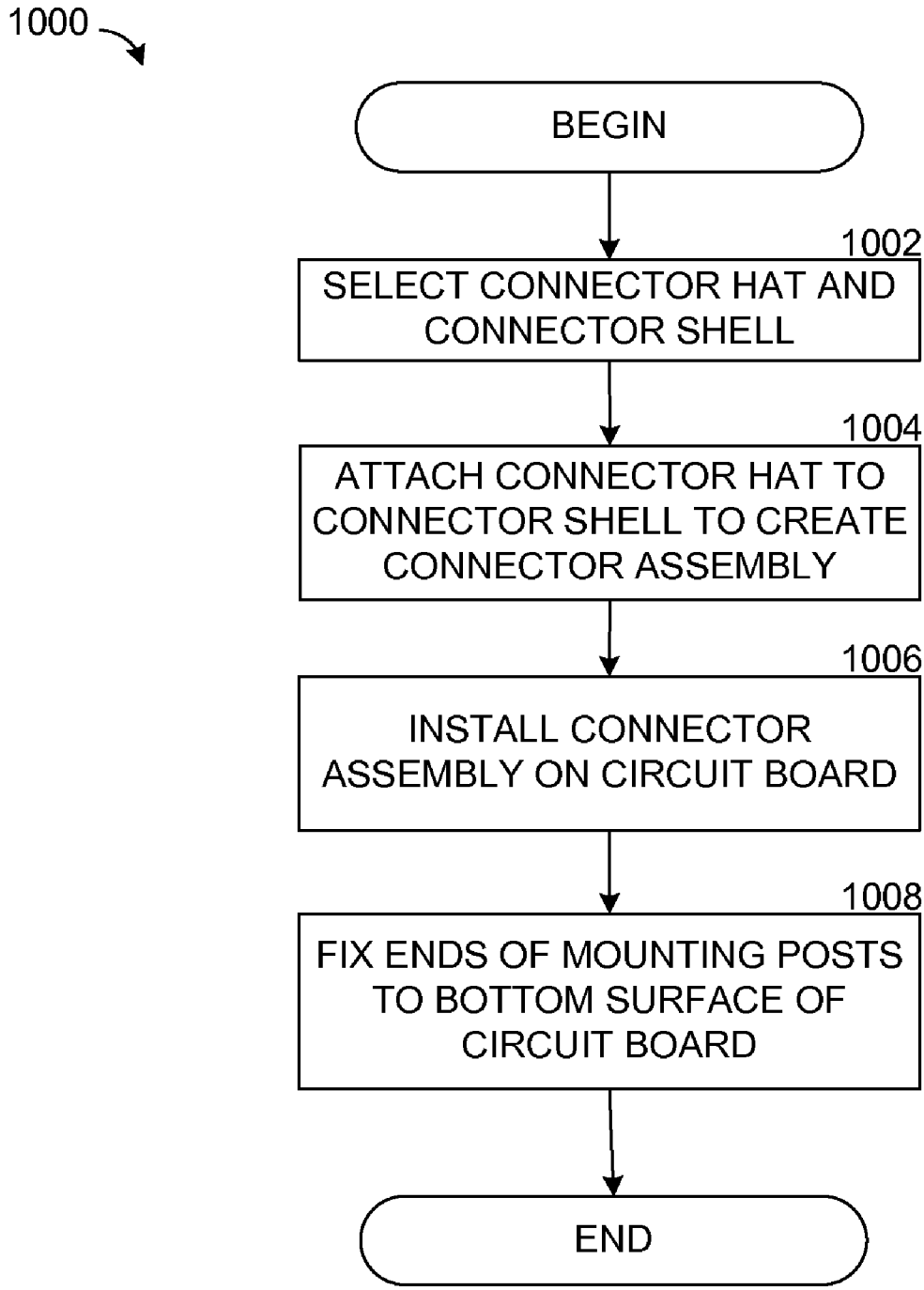
FIG. 10 is a flow diagram, illustrating a method for securing a connector shell to a circuit board with a connector hat according to embodiments described herein.

Turning now to FIG. 10, an illustrative routine 1000 for securing a connector shell 204 to a circuit board 206 using a connector hat 102/502 will be described in detail. It should be appreciated that more or fewer operations may be performed than shown in the figures and described herein. These operations may also be performed in a different order than those described herein. The routine 1000 begins at operation 1002, where the connector hat 102/502 and connector shell 204 are selected according to the particular implementation. It should be appreciated that the routine 1000 may be executed by a computer and corresponding robotics system such that preprogrammed instructions stored within a computer memory or other computer-readable media and executed by a connector assembly application or program module may be utilized to perform the various operations of routine 1000.

At operation 1004, the connector hat 102/502 is attached to the connector shell 204 to create the connector assembly 202/602. This attachment may be facilitated by the locking tabs 308 and corresponding slots 112/116. From operation 1004, the routine 1000 continues to operation 1006, where the connector assembly 202/602 is installed on the circuit board 206 by mating the electrical contacts 304 and circuit board contacts 306, and by inserting the mounting posts 106 through the corresponding circuit board apertures 302 so that the distal ends of the mounting posts 106 protrude through the bottom surface of the circuit board 206. At operation 1008, the protruding ends of the mounting posts 106 are fixed to the bottom surface of the circuit board 206 via soldering or other suitable means, and the routine 1000 ends.

Based on the foregoing, it should be appreciated that technologies for securing a connector shell 204 to a circuit board 206 utilizing a separate connector hat 102/502 with elongated mounting posts 106 have been disclosed herein. It is to be understood that the invention defined in the appended claims is not necessarily limited to the specific features, configurations, acts, or media described herein. Rather, the specific features, configurations, acts and mediums are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the present disclosure, which is set forth in the following claims.

What is claimed is:

1. A connector hat for securing a connector shell to a circuit board, comprising:

a one-piece connector hat body adapted to attach to a top surface of a connector shell, the one-piece connector hat body comprising a top surface, and a pair of mounting posts extending downward from opposing side edges of the top surface, each of the pair of mounting posts being of greater length than a height of the connector shell such that the pair of mounting posts extends beyond a bottom surface of the connector shell when attached for mounting the connector hat and the connector shell to the circuit board; at least two slots positioned proximate to the opposing side edges of the top surface, each of the at least two slots configured to receive a corresponding locking tab on the connector shell; and wherein the one-piece connector hat body further comprises a slot positioned within each mounting post proximate to a location where the mounting post bends into the top surface.

2. The connector hat of claim 1, wherein the one-piece connector hat body further comprises a securing tab extending from a front edge of the top surface and configured to attach the connector hat to a computer or other structural component.

3. The connector hat of claim 2, wherein the securing tab extends upward approximately 90 degrees from the front edge of the top surface and comprises a fastener aperture configured for receiving a fastener to connect the one-piece connector hat body to the computer or other structural component abutting the securing tab.

4. The connector hat of claim 1, wherein each of the pair of mounting posts extend downward approximately 90 degrees from a plane defined by the top surface.

5. The connector hat of claim 4, wherein each of the pair of mounting posts being of greater length than the height of the connector shell such that the pair of mounting posts extends beyond the bottom surface of the connector shell when attached for mounting the connector hat and the connector shell to the circuit board comprises each of the pair of mounting posts extending greater than 2 millimeters beyond the bottom surface of the connector shell.

6. The connector hat of claim 4, wherein each of the pair of mounting posts being of greater length than the height of the connector shell such that the pair of mounting posts extends beyond the bottom surface of the connector shell when attached for mounting the connector hat and the connector shell to the circuit board comprises each of the pair of mounting posts extending approximately 3.2 millimeters beyond the bottom surface of the connector shell.

7. The connector hat of claim 1, wherein the one-piece connector hat body comprises two additional slots, each additional slot positioned within a side edge of the top surface aft of a mounting post.

8. The connector hat of claim 1, wherein an underside of the top surface comprises a recessed area configured to provide a gap between the connector hat and the top surface of the connector shell allowing for upward movement of retention springs within the connector shell that secure a connector to the connector shell when mating.

9. A connector assembly, comprising:

a connector shell having a shell top surface, a shell bottom surface, opposing shell side surfaces, and a height defined between the shell top surface and the shell bottom surface; and a connector hat, comprising a one-piece connector hat body attached to the shell top surface, the one-piece connector hat body having a hat top surface, and a pair of mounting posts extending downward from opposing side edges of the hat top surface such that the pair of mounting posts overlap the opposing shell side surfaces, each of the pair of mounting posts being of greater length than the height of the connector shell such that the pair of mounting posts extends beyond a bottom surface of the connector shell for mounting the connector assembly to a circuit board; the one-piece connector hat body comprises a slot positioned within each mounting post proximate to a location where the mounting post bends into the hat top surface; and wherein the one-piece connector hat body further comprises two additional slots, each additional slot positioned within a side edge of the top hat surface aft of said mounting post.

10. The connector assembly of claim 9, wherein the connector shell comprises a High Definition Multimedia Interface (HDMI) connector that does not include mounting posts for mounting the HDMI connector to a circuit board.

11. The connector assembly of claim 9, wherein each of the pair of mounting posts being of greater length than the height of the connector shell such that the pair of mounting posts extends beyond the bottom surface of the connector shell for mounting the connector assembly to the circuit board comprises each of the pair of mounting posts extending greater than 2 millimeters beyond the bottom surface of the connector shell.

12. The connector assembly of claim 9, wherein each of the pair of mounting posts being of greater length than the height of the connector shell such that the pair of mounting posts extends beyond the bottom surface of the connector shell for mounting the connector assembly to the circuit board comprises each of the pair of mounting posts extending approximately 3.2 millimeters beyond the bottom surface of the connector shell.

13. The connector assembly of claim 9, wherein the one-piece connector hat body further comprises a securing tab extending from a front edge of the top hat surface and configured to attach the connector hat to a computer or other structural component.

* * * * *